United States Patent [19]

Rossow

[11] Patent Number: 4,892,979

[45] Date of Patent: Jan. 9, 1990

[54] MULTI-PIECE INSULATING BUSHING AND METHOD OF SECURING AN ELECTRICAL CONDUCTOR THERETO

[76] Inventor: Leroy J. Rossow, 11050 50th St. North, Lake Elmo, Minn. 55042

[21] Appl. No.: 203,083

[22] Filed: Jun. 7, 1988

[51] Int. Cl.[4] ..... H01B 17/26

[52] U.S. Cl. ..... 174/153 G; 248/56

[58] Field of Search ..... 174/65 G, 135, 152 G, 174/153 G, 155, 156; 16/2; 248/56, 74.3; 439/464, 467, 471

[56] References Cited

U.S. PATENT DOCUMENTS

| | | | |
|---|---|---|---|
| 1,956,526 | 4/1934 | Ellmann | 174/155 |
| 3,011,745 | 12/1961 | Reid | 248/56 |
| 3,493,205 | 2/1970 | Bromberg | 174/153 G X |
| 3,788,582 | 1/1974 | Swanquist | 174/153 G X |
| 3,889,909 | 6/1975 | Koscik | 174/153 G X |
| 4,289,288 | 9/1981 | Gransberry et al. | 174/153 G X |
| 4,369,944 | 1/1983 | Hobart, Jr. | 248/56 |

*Primary Examiner*—Laramie E. Askin

*Attorney, Agent, or Firm*—Douglas L. Tschida

[57] ABSTRACT

A hinged, two-piece molded plastic member foldable to form a bulkhead bushing for electrical conductors. A flexibly tapered, notched, multi-fingered inner end restrains the bushing to a junction box. In one embodiment, an inwardly projecting wedging member and a serrated wrap member and latch releasably restrain one or more electrical conductors to the bushing. In another embodiment, the wrap member and multiple mating latch arms secure the conductors and bushing halves to one another.

19 Claims, 7 Drawing Sheets

MULTI-PIECE INSULATING BUSHING AND METHOD OF SECURING AN ELECTRICAL CONDUCTOR THERETO

BACKGROUND OF THE INVENTION

The present invention relates to the installation of electrical conductors to junction boxes and, in particular, to a molded bulkhead bushing for protecting and restraining the conductors in a fashion which facilitates the initial mounting of the conductors and accommodates possible future expansion.

As labor costs increase for the installation of new and remodeling of old electrical supply systems, a need exists for improved wiring devices to facilitate installation, yet accommodate expansion, should future needs require the stringing of additional conductors. Depending upon the application and relevant electrical code, various wiring techniques are employed; although with greater frequency, for both commercial and residential installations, nonmetallic conductors are being strung in lieu of rigidwalled, conductor-receiving conduits. This type of installation, in turn, creates the necessity of mounting a bushing of some type at each junction box to protect the wiring as it passes through the box wall. Provisions must also be made to restrain the conductors at or near the bushing to minimize possible flexion and abrasion of the insulative coverings of the conductors and resultant shorting or grounding of the conductors.

Heretofore, a variety of cast aluminum or zinc bushing/box connectors have been used which essentially comprise a tubular member having a threaded, nut-receiving end which secures the bushing to the box and an outer arcuate end which includes a threaded band clamp for compressively clamping the wire to the arcuate collar to restrain same.

One known plastic bushing of which Applicant is aware is shown in U.S. Pat. No. 3,493,205. There an insulative plastic tubular bushing is disclosed which includes a multifingered flexible end which upon inserting the tapered fingers through a provided hole, expand to secure the bushing to the box. The conductors are secured to the bushing via a serrated wedging member which mounts in a slotted channel formed in the bushing sidewalls at a transverse angle to the conductors. Once mounted, however, the wedging member is removable only with great difficulty. Yet another bushing is disclosed in U.S. Pat. No. 3,788,582 which provides for a rotatable cam member to secure the conductors to the bushing. The manner of securing the conductors to the bushing of each of the foregoing devices is, however, believed distinguishable from the present invention.

SUMMARY OF THE INVENTION

The present invention accordingly seeks to provide a new and improved non-metallic bushing which may be readily molded without undue difficulty and at relatively high yields, yet restrains the conductors to the junction box in a fashion which readily accommodates future expansion.

It is accordingly a primary object of the invention to provide a low cost insulative bushing which is restrainably, removably mountable to a junction box.

It is further object of the invention to restrain the mounted conductors in a fashion which readily permits the addition of new conductors.

It is a further object of the invention to provide a multi-piece bushing which may be injection molded in a two-piece die, yet which pieces interlock with one another when mounted.

It is a still further object of the invention to provide a size-adjustable wedging member within the conductor receiving bore of the bushing to restrain wire movement.

It is a yet further object of the invention to provide a wrapped binding assembly for securing the conductors to the bushing and which is releasable without undue effort.

The foregoing objects and advantages of the invention are particularly achieved in the presently preferred constructions which in one embodiment comprises a hinged, two-piece tubular bushing. The arcuate halves of the bushing are injection molded in a single set of dies to include a related hinge, flexible box restraint fingers, a parting line containing wedging member, a wire tie, and a releasable collared latch. Also provided are interlocking channels formed in the longitudinal mating surfaces of the bushing halves.

Otherwise, a plurality of tapered, flexible restraint fingers project from one end of the bushing and include an annular notch whereat the bushing is compressively restrained to a junction box. A transverse wedging member projecting from one of the bushing halves and including a plurality of removable flap portions defines the free space in the bore and restricts conductor movement. An outer arcuate tower member including an elongated, serrated wrap member and the collared latch secure the conductors to the bushing. The collared latch is additionally formed to be releasable from the wrap serrations.

In an alternative embodiment of the invention, a pair of full-height bushing halves are hinge molded to one another and similarly include annularly notched junction box securing restraint fingers. A pair of fingers also arcuately project from the edge of one half to align on either side of a collared latch formed in the mating half. Internally formed arcuate ridge members transversely extend about the interior bore of the bushing halves and border a cutout containing a second latch formed in one of the bushing halves.

In use, a serrated wire wrap member extending from the edge of one bushing half, between the alignment fingers, wraps about wire conductors longitudinally mounted within the bushing half, and is secured thereto upon passing the wrap member through the cutout/-latch and whereupon the bushing is slidably mounted to the connector box. The bushing halves, in turn, are secured to one another upon carrying the wrap member about the outer circumference of the bushing and securing it to the collared latch. The wire wrap member thus secures the conductors to the bushing and the bushing halves to one another.

The above objects, advantages and distinctions of the invention, among others, along with a detailed description of the presently preferred and variously considered alternative embodiments are described hereinafter with respect to the appended drawings. It is to be appreciated, however, that the following description is illustrative only of the presently considered embodiments of the invention, which are not exhaustive of all forms, and should not be interpreted in limitation of the scope of the invention. To the extent modifications have been considered, they are described as appropriate.

DESCRIPTION OF THE PREFERRED EMBODIMENTS

Figure 1:
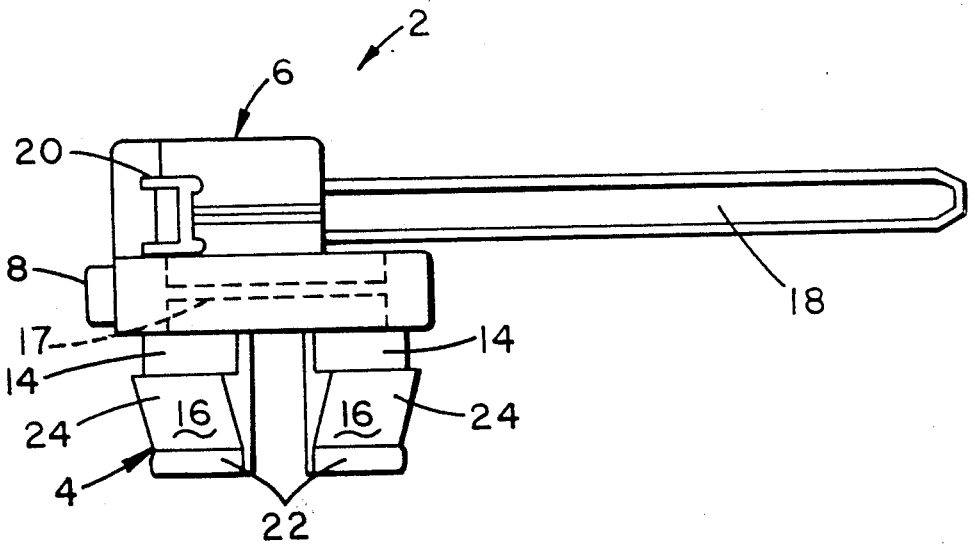
FIG. 1 is a front elevational view of a folded bushing of the present invention.
Figure 2:
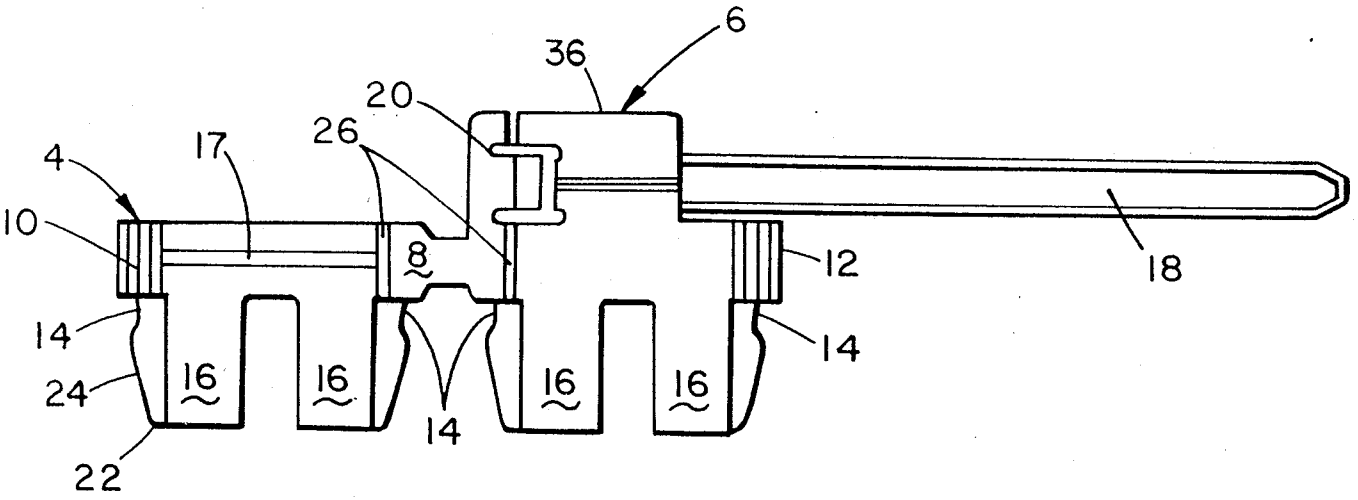
FIG. 2 is a front elevational view of the unfolded bushing of FIG. 1.

Referring to FIGS. 1 and 2, FIG. 1 is a front elevational view of the molded plastic bushing 2 of the present invention as it appears when the halves are folded together. FIG. 2, in turn, shows a front elevational view of the bushing in its unfolded condition, as it appears prior to mounting to a junction box and one or more electrical conductors.

In its normal application, the bushing 2 is mounted to electrical junction boxes to protect and restrain in a nonabrading fashion, electrical conductors which are passed therethrough. That is, upon folding the bushing halves 4 and 6 together and inserting the bushing 2 into a hole in a bulkhead, a hinge 8 and mating longitudinal edge surfaces 10 and 12 form the bushing into a tubular shape. Annular notch 14 containing flexible fingers 16, upon insertion into the mounting hole, expand to restrain and maintain the tubular shape of the bushing 2 relative to the junction box (not shown). Electrical conductors are thereafter inserted through and secured to the bushing 2 via a wire wrap member 18 and collared latch 20, prior to making the desired electrical connections of the conductors.

In contrast to the bushing of U.S. Pat. No. 3,493,205 and various other rubber or plastic ring bushings of which Applicant is aware and which provide no clamp action, the foregoing construction not only protects the conductors, but secures them to the junction box in a fashion which accommodates future expansion. It also does so in a construction which lends itself to injection molding and attendant low cost production.

Returning attention to the flexible fingers 16, it is to be appreciated that each provides for a notched, tapered tang, the extreme ends of each which include a vertical walled portion 22 and an outwardly flaring tapered portion 24, the flare angle of which steepens, up to the edge of a notch 14. Depending upon the size of the conductors to be contained by the bushing 2 and the size of the mounting hole, the annular diameter presented by the fingers 16, when the bushing halves 4, 6 are folded together, is sized such that the fingers 16 flex upon insertion and re-expand, once the notch 14 is reached and the bushing 2 is pushed home. That is, upon passing the widest point of the hole in the junction box, the fingers 16 re-expand and restrain the bushing 2 to the junction box at the annular notch 14 presented by the folded combination of the fingers 16.

Although in practice, the bushing 2 is not normally released from the junction box, it is to be appreciated that upon compressing the four fingers 16, the bushing might be released and possibly replaced with a larger bushing, assuming the box provides for a larger knockout at the same or another hole.

Figure 3:
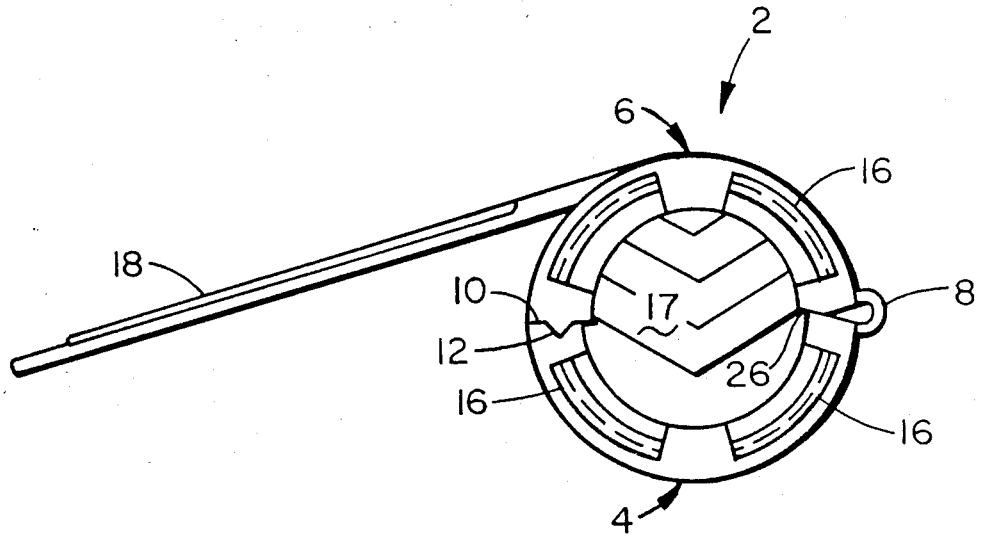
FIG. 3 is a bottom plan view of the unfolded bushing of FIG. 1.
Figure 4:
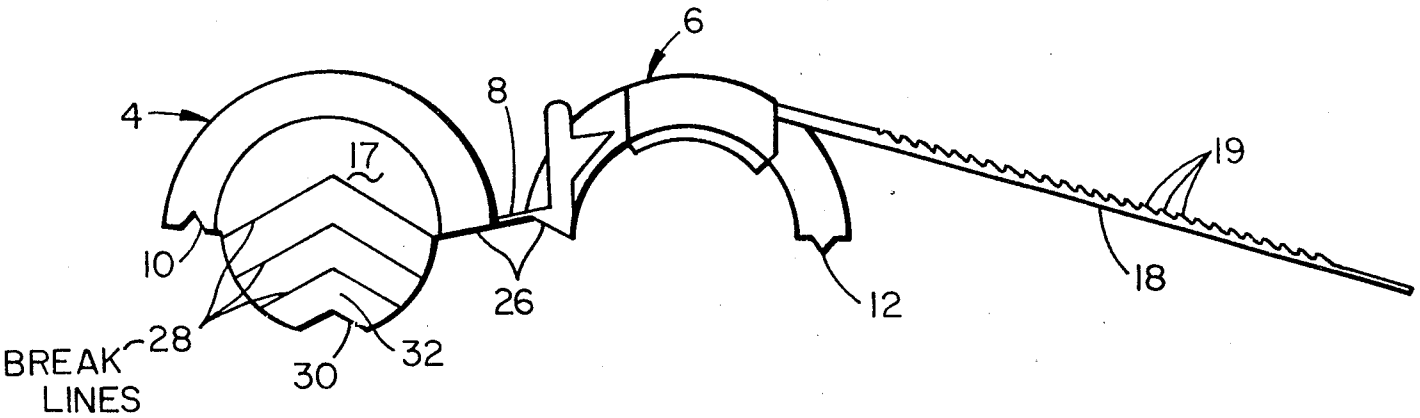
FIG. 4 is a top plan view of the bushing of FIG. 1.

Referring next to the hinge 8 and mating longitudinal surfaces 10 and 12, attention is additionally directed to FIGS. 3 and 4 wherein bottom and top plan views are shown of the folded and unfolded bushing of FIG. 1. From these views, a better appreciation is had of the manner in which the bushing halves 4 and 6 mount to one another when folded. In particular, the mating longitudinal V-shaped groove surface 10 in the bushing portion 4 and the V-shaped protrusion surface 12 in the bushing portion 6 are more apparent.

Upon folding the halves 4, 6 together, the surfaces 10 and 12 lock to one another, while the hinge 8 restrains the opposite longitudinal flat edge surfaces 26. When mounted in the junction box, the diameter of the notch 14 is such that the halves 4, 6 remain compressed. Although, too, a V-shaped longitudinal interlock is provided, it is to be appreciated that other arrangements might equally be employed. For example, mating dimples/holes or possibly mating dovetail or overlapping offset channels at the mating longitudinal surfaces would provide for a positive locking action between the two halves 4, 6.

With continuing attention to the plan views of FIGS. 3 and 4 and referring to the wedging member 17, it includes a number of ridged parting or break lines 28 whereat the size of the member 17 may be reduced to accommodate additional conductors within the bore of the bushing 2. In its unaltered condition, the member 17 is of a generally circular construction, except for a V-shaped end relief 30, which relative to the bushing bore allows for the passage of a single conductor. If additional conductors are to be mounted to the bushing 2, the end portion 32 is broken off at the first parting line 28 to provide additional space within the bore. Similarly for more or larger conductors, other portions can be broken off to properly size the wedging member 17 to the required bore space. The purpose of the member 17, however, is to minimize the available free space within the bore and provide some compressive action relative to the mounted conductors. It is also to be appreciated that the height of the bushing half 4 relative to the half 6 is such that the wedging member may be sized with the bushing 2 in its mounted position.

Once the bushing 2 and wedge member 17 have been properly sized and mounted relative to the conductors to be threaded through the bore area, the installer wraps the wrapping member 18 about the conductors and threads the distal end through the collared latch 20 to secure the conductors to the bushing half 6. In that regard, attention is directed to FIGS. 4, 5 and 6 wherefrom a better appreciation can be had of the construction of the collar and its contained latch relative to the outer serrations 19 of the wrapping member 18.

FIG. 4 shows that the wire wrap member 18 extends from one edge of an arcuate outer tower 36 of the bushing portion 6. The tower 36 extends substantially around the portion 6 to partially surround the contained conductors. It also supports the collared latch 20 from its opposite longitudinal edge.

Figure 6:
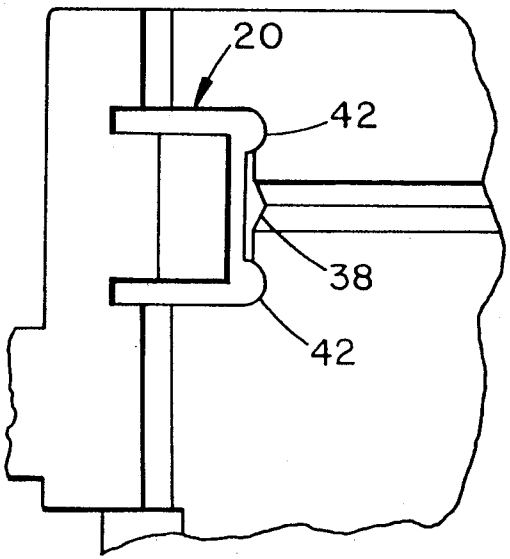
FIG. 6 is a detailed front elevational view of the collared latch of FIG. 1.
Figure 5:
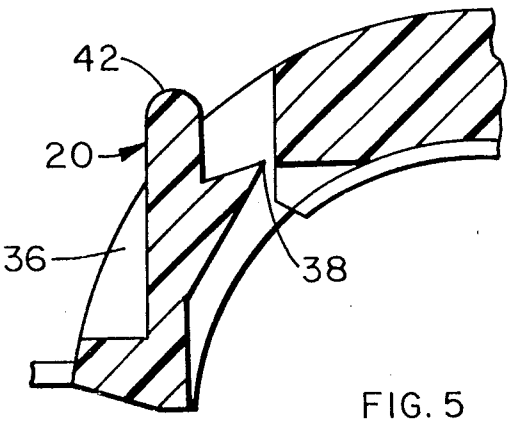
FIG. 5 is a detailed cross-sectional view through the wrap-engaging collared latch of FIG. 1.

FIGS. 5 and 6 particularly depict the flexible vertical tang 38 of the collared latch 20 which tang 38 engages the serrations 19 of the wrapping member 18 as they pass thereby. That is, the tip of the tang 38 is normally biased to flexibly engage the sawtooth serrations 19 lying therebeneath in a non-reversing fashion. The tolerances are such that the wrapping member 18 is slightly thicker than the space otherwise provided between the tip of the tang 38 and the adjacent surface of the tower 36, whereby the tang 38 is resiliently biased into contact with the serrations 19. Upon, however, inserting a screwdriver or other implement between the tower 36 and the rounded tip 42 of the tang 38, the tang 38 may be disengaged from the serrations 19 and the wrapping member 18 removed or at least released a sufficient amount to permit the insertion of additional conductors, provided the wedging member 17 is properly sized. Consequently, additional conductors may be added over time to fill the bushing 2, with only a minimal amount of time lost to properly size the wedging member 17, and all without damage to the bushing 2.

In passing and with attention to wrapping member 18 and FIG. 4, it is to be noted the edges of the outermost end of the member 18 are chamfered and laterally tapered to facilitate the initial engagement of the member 18 with the latch tang 38. Otherwise, the thickness of the member 18 progressively increases over its length, whereby correspondingly greater amounts of compressive pressure are thereby provided between the tang 38 and the wrap member 18 as it is drawn about the conductors. Although, too, a single wrap member 18 is shown, it is to be appreciated that multiple wrap members 18 might be mounted to the tower 36, depending upon the types and sizes of conductors to be mounted to the bushing 2. Similarly, it is contemplated that other available wire ties and/or staples might be used to restrain the conductors to adjacent structural framing members.

Attention is next directed to FIGS. 7, 8, 9 and 10 wherein an alternative wire wrapped bulkhead conductor bushing 50 is shown relative its sequential mounting to a typical electrical conductor. With attention first directed to FIGS. 7 and 8, elevational and isometric views are shown of the bushing 50 which, again, is comprised of a pair of arcuate halves 52 and 54 which are hinge-coupled to one another via a hinge 56. The longitudinal length of the bushing 50 is, again, also generally segregated into a lower junction box retainer portion 58 and an upper conductor retainer portion 60.

Relative to the former junction box retainer portion 58, in lieu of a multiplicity of flexible fingers, two arcuate fingers 62 are provided which when folded present an outer diameter slightly less than a nominally specified mounting hole size. An L-shaped arcuate cutout 66 formed in the body of each finger 62 borders a flexible solid finger 68, the outer surface of each of which fingers 68 provides for a tapered surface 70 of successively increasing diameter which increases to a tapered upper annular ledge 72 (reference Figure 10).

An annular stop shoulder 74 spaced away from the ledge 72 by an intervening notch 76 defines the lower extreme of the upper conductor retainer portion 60. The annular notch 76 functions as the groove 14. Instead, however, of the fingers 62 flexing, the tapered wall surface 70 of the fingers 68 flexes inwardly as the bushing 50 is mounted to a connector box and relative to the L-shaped cutouts 66. Once the bushing 50 is pushed past the ledge 72, the finger walls 70 expand to secure the bushing 50 to the connector box within the groove 76.

Figure 7:
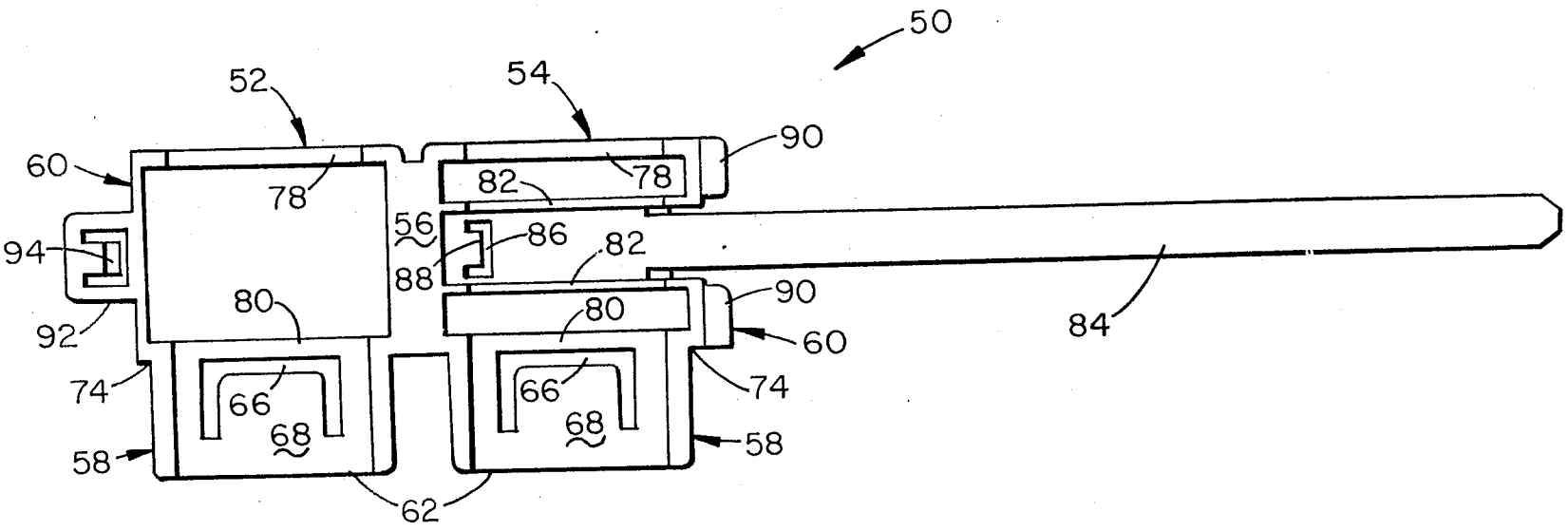
FIG. 7 is a front elevational view of an unfolded alternative embodiment of the invention.
Figure 8:
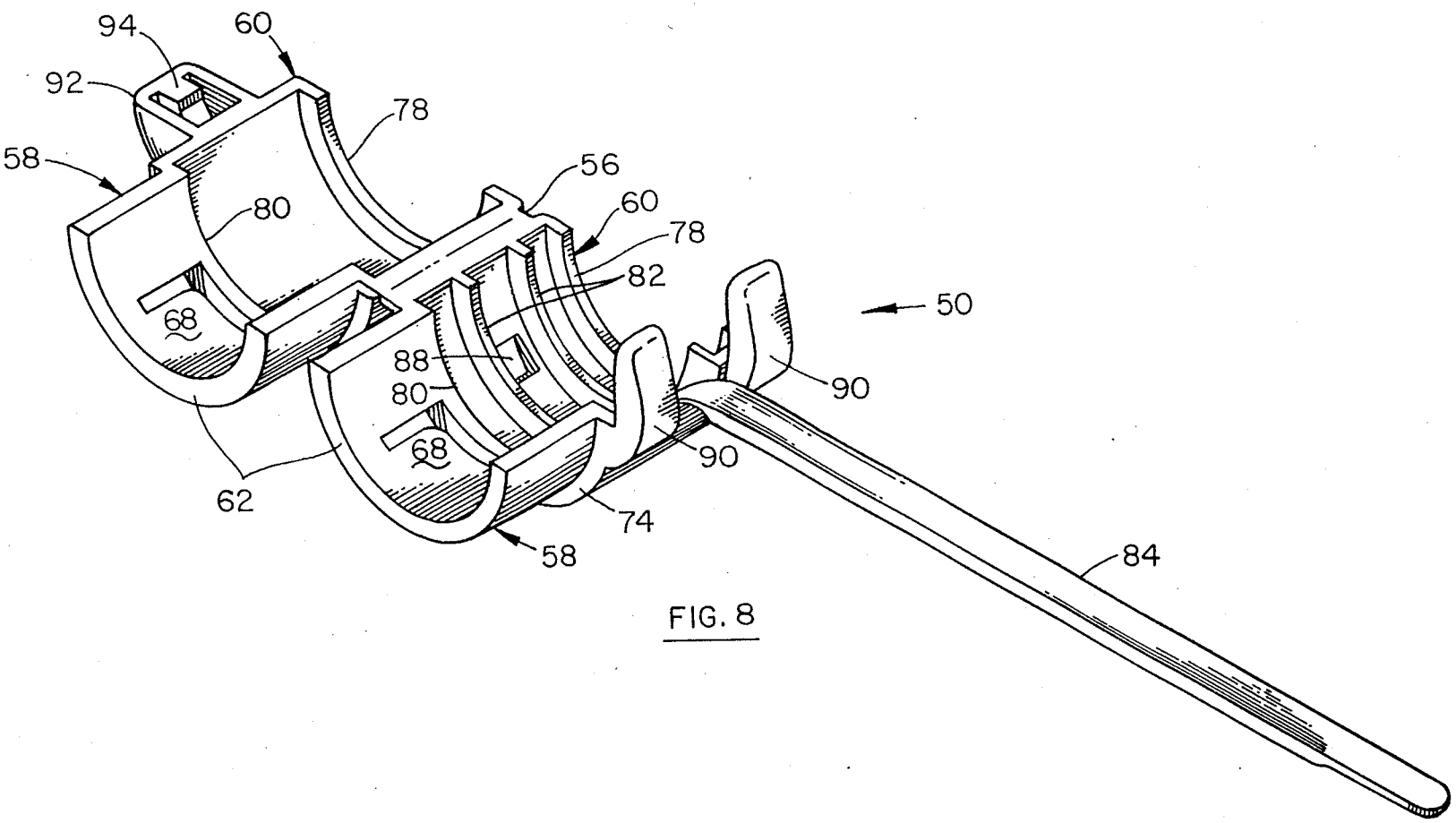
FIG. 8 is an isometric view of the bushing of FIG. 7, when folded open.

Redirecting attention to FIG. 7, the interior of the arcuate halves 52, 54 each provides for an upper and lower annular ridge 78 and 80. A pair of intermediate annular ridges 82 are also provided in the wire wrap supporting bushing half 54. Each of the ledges extends equidistantly inwardly of the bushing halves to define a generally cylindrical bore of a diameter equal to that of the inner wall diameter of the connector box fingers 62. Although the annular ridges 78, 80 serve to strengthen the bushing walls, it is to be appreciated that the ledges might be deleted.

As presently provided, too, the intermediate annular ledges 82 define a channelway relative to the wrapping member 84 which extends from the edge of the bushing half 54 and between which and in the area adjacent the hinge member 56 a U-shaped cutout 86 is formed in the bushing wall. The outer surface edge 88 of the wall portion remaining within the cutout 86 provides for a first latch member which cooperatively interacts with the sawtooth serrated edges 89 of the wire wrap member 84 (reference Figures 9 and 10).

Otherwise, arcuately extending from the outer edge of the wire wrap containing bushing half 54, to either side of the intermediate ledges 82, are a pair of alignment fingers 90. The alignment fingers 90 are positioned to align on either side of a latch collar 92 radially projecting from the outer wall of the mating bushing half 52. A flexibly resilient latch arm 94 extends downwardly and inwardly from the outer rim of the latch collar 92, and like the tang 38 of collared latch 20 and of FIG. 5 similarly permits the flexible release of the latch arm 94 and loosening of the secure wire wrap member 84.

Figure 9:
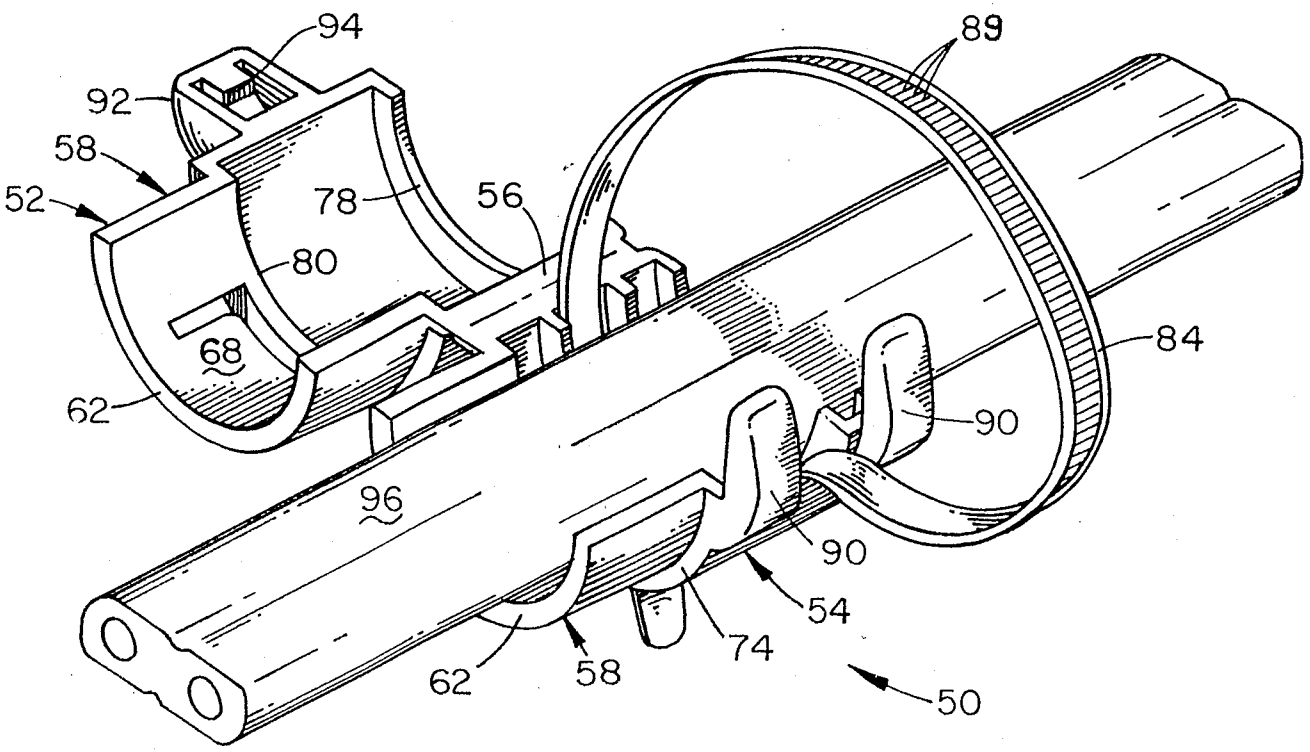
FIG. 9 is an isometric view of the bushing of FIG. 8 with the wire wrap member in wrapped relation to a confined electrical conductor.
Figure 10:
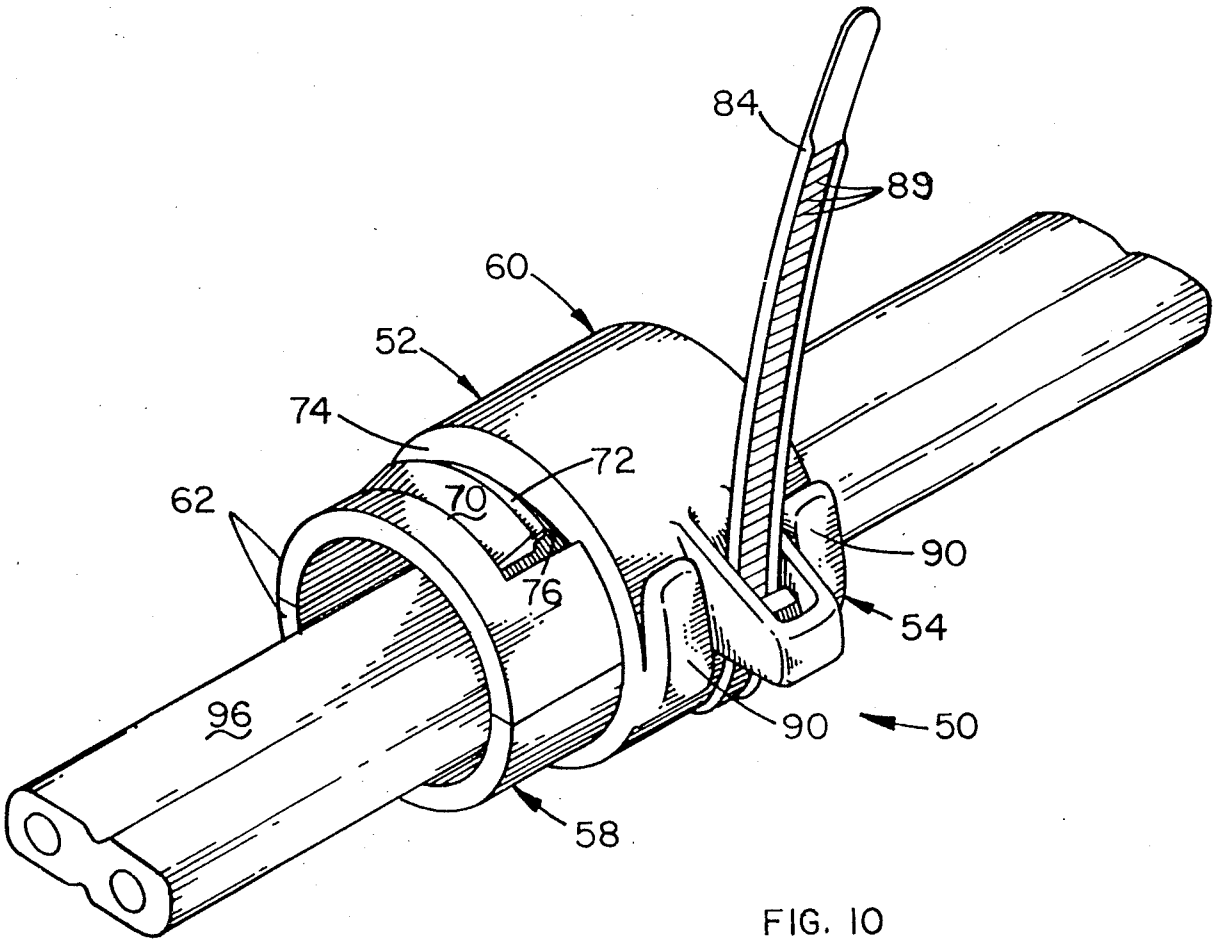
FIG. 10 is an isometric view of the bushing of FIGS. 7 and 8 with the wire wrap member securing the bushing halves to one another and about the restrained conductor.

In the latter regard and relative to the typical sequence of events when using the wire wrap member 84, particular attention is directed to FIGS. 9 and 10. FIG. 9 depicts a typical two-wire conductor 96 longitudinally supported within the through bore of the bushing half 54 and relative to which the wire wrap member 84 has been wrapped and inserted through the cutout 86 in the bushing body. Upon drawing the wrap member 84 tight to the first latch member 88, the conductor 96 is secured to the bushing half. Although a single non-metallic, two-wire conductor 96 is shown, it is to be appreciated that the bushing is capable of supporting a rated number of single of multi-wire conductors within the bore of the bushing. In all events, however, the conductors 96 are secured to the bushing half, upon drawing the wire wrap member 84 tight to the first flexible latch member 88.

Once the conductors 96 are secured, the mating hinged half 52 of the bushing 50 is folded over, such that the latch collar 92 aligns between the alignment fingers 90 (reference Figure 10). The bushing is then inserted into the junction box and the wrap member 84 is drawn tight, if not previously tightened. The wrap member 84 is then arcuately passed back over and about the outer body of the mating bushing halves and through the latch collar 92, with the latch arm 94 also mating with the serrations 89. Upon again drawing the wrap member 84 tight, the bushing halves 52, 54 are thus secured to one another in mating relation and the conductors 96 are secured in protected relation to the formed bushing, which if not previously, may then be inserted into the junction box.

While the present invention has been described with respect to its presently preferred embodiment and various contemplated modifications thereto, it is to be appreciated that still other modifications might be made without departing from the spirit and scope of the described invention. It is accordingly contemplated that the following claims should be interpreted so as to include all those equivalent embodiments within the spirit and scope thereof.

What is claimed is:

1. A bushing comprising a tubular body member having a lengthwise coextensive bore for receiving elongated through members, a bulkhead fastener portion and a through member fastener portion, wherein said through member fastener portion is defined by an arcuate portion of said body member mountable exteriorly of a bulkhead and includes:
(a) a collar having a through aperture;
(b) an elongated wrap member positioned to circumscribe through members when positioned in said bore and to mount in said collar;
(c) means for restraining said wrap member when cinched about said through members; and
(d) a wedging member transversely extending from an interior wall of the bore of said body member.

2. Apparatus as set forth in claim 1 wherein said wedging member comprises a plurality of removable portions.

3. Apparatus as set forth in claim 2 wherein each removable portion of said wedging member is defined by a plurality of rigid parting lines separating each portion from each other.

4. Apparatus as set forth in claim 1 wherein said body member comprises first and second arcuate longitudinal portions which mount to one another to form said body member.

5. Apparatus as set forth in claim 4 wherein said arcuate longitudinal portions are hinged to one another.

6. Apparatus as set forth in claim 4 wherein at least one of a longitudinal edge of each of said first and second portions includes a surface formed to interlock with an edge of the other first and second portions.

7. Apparatus as set forth in claim 6 wherein one of said edges includes a V-shaped channel and the other a V-shaped protrusion.

8. Apparatus as set forth in claim 1 wherein said collar includes a flexible latch resiliently contacting said wrap member to restrict removal, once inserted.

9. Apparatus as set forth in claim 8 wherein the surface of said wrap member engaging said latch includes a plurality of ridged projections which cooperatively prevent the removal of said wrap member.

10. Apparatus as set forth in claim 8 wherein said collar is formed such that said latch may be flexed away from said wrap member to permit the removal thereof.

11. Apparatus as set forth in claim 1 wherein said bushing is integrally molded from an electrically insulative material.

12. Apparatus as set forth in claim 1 wherein said bulkhead fastener portion comprises a plurality of elongated flexible fingers the outer surfaces of which progressively taper outwardly from an outermost end as they extend inward to a bulkhead receiving channel.

13. A bushing comprising first and second molded arcuate longitudinal body member portions hinged in interlocking relation to one another which when folded together define a body member having a lengthwise coextensive bore for receiving elongated members therethrough, said body member including a bulkhead fastener portion and a through member fastener portion, wherein said through member fastener portion is defined by an arcuate portion of said body member mountable exteriorly of a bulkhead and includes:
(a) a collar having a through aperture;
(b) an elongated wrap member positioned to circumscribe through members when inserted in said bore and to mount in said collar;
(c) means for restraining said wrap member when cinched about said through members; and
(d) a wedging member transversely extending from an interior wall of the bore of said body member.

14. Apparatus as set forth in claim 13 wherein said bulkhead fastener portion comprises a plurality of elongated flexible fingers the outer surfaces of which progressively taper outwardly from an outermost end as they extend inward to a bulkhead receiving channel.

15. A bushing comprising:
(a) first and second molded arcuate longitudinal body portions hinged in interlocking relation to one another which when folded together define a body member having a lengthwise coextensive bore for receiving elongated through members therethrough;
(b) a wedging member transversely extending from an interior wall of the bore of said body member;
(c) an elongated wrap member having at least one serrated surface positioned to circumscribe the through members when mounted in said bore; and
(d) means including a flexible latch for engaging the serrations of said wrap member and restricting removal, except when said latch is disengaged from said serrations.

16. Apparatus as set forth in claim 15 including a bulkhead fastener portion comprising a plurality of elongated flexible fingers the outer surfaces of which progressively taper outwardly from an outermost end as they extend inward to a bulkhead receiving channel.

17. Apparatus as set forth in claim 15 wherein the first arcuate body portion includes an aperture extending through a sidewall thereof, wherein a resilient latch member obstructs said aperture and wherein said wrap member, upon being passed through said aperture, when said first and second body portions are folded open, secures the through members in the bore.

18. Apparatus as set forth in claim 17 wherein the second arcuate body portion includes a radially extending collar having said flexible latch resiliently obstructing a bore of said collar and wherein, upon folding the first and second body portions closed and after said wrap member is passed through said aperture, a free remaining end of said wrap member upon being wrapped about the outer surface of said body member and through said flexible latch secures said first and second body portions to one another.

19. A method for securing an electrical conductor to a multi-piece bushing comprising the steps of:
(a) mounting at least one electrical conductor in a longitudinal bore of a tubular bushing member comprised of a plurality of portions which portions align with one another to define said bore;
(b) passing a wrap member about said conductor and relative to a first latch means to secure said conductor to at least one of said portions; and
(c) passing a remaining end of said wrap member about an outer surface of said bushing member and relative to a second latch means to secure the portions of said bushing member to one another.

* * * * *